US006682604B1

(12) United States Patent
Nulwala

(10) Patent No.: US 6,682,604 B1
(45) Date of Patent: Jan. 27, 2004

(54) RESTORATION OF CONTAMINATED POLYMER ARTICLES

(75) Inventor: Hunaid Nulwala, Rochester, NY (US)

(73) Assignee: Rochester Institute of Technology, Rochester, NY (US)

( * ) Notice: Subject to any disclaimer, the term of this patent is extended or adjusted under 35 U.S.C. 154(b) by 141 days.

(21) Appl. No.: 09/862,609

(22) Filed: May 22, 2001

Related U.S. Application Data

(60) Provisional application No. 60/206,114, filed on May 22, 2000.

(51) Int. Cl.[7] ..... B08B 3/00

(52) U.S. Cl. ..... 134/1; 134/10; 134/13; 134/19; 134/26; 134/34; 134/35; 134/36; 134/30; 134/40; 134/42

(58) Field of Search ..... 134/1, 10, 13, 134/19, 26, 34, 35, 36, 30, 40, 42

(56) References Cited

U.S. PATENT DOCUMENTS

| | | | | | |
|---|---|---|---|---|---|
| 3,222,221 | A | * | 12/1965 | Branson | 134/1 |
| 3,553,146 | A | * | 1/1971 | Butke | 134/22.14 |
| 3,755,184 | A | * | 8/1973 | Mizuno | 510/235 |
| 4,582,733 | A | * | 4/1986 | McCord | 427/430.1 |
| 5,876,510 | A | * | 3/1999 | Kuemin et al. | 134/12 |
| 2002/0010117 | A1 | * | 1/2002 | McDonald | 510/215 |

FOREIGN PATENT DOCUMENTS

DE 4025039 A * 2/1992

* cited by examiner

*Primary Examiner*—Sharidan Carrillo
(74) *Attorney, Agent, or Firm*—Nixon Peabody LLP

(57) ABSTRACT

A method of restoring a contaminated polymer article including contacting a contaminated polymer article with an oil which is not a plasticizer under conditions effective to remove substantially all contaminants present on the polymer article to produce a restored polymer article.

19 Claims, No Drawings

RESTORATION OF CONTAMINATED POLYMER ARTICLES

The present invention claims the benefit of U.S. Provisional Patent Application Serial No. 60/206,114, filed May 22, 2000, which is hereby incorporated by reference in its entirety.

FIELD OF THE INVENTION

The present invention relates to methods of restoring a contaminated polymer article.

BACKGROUND OF THE INVENTION

Polymer articles are used in numerous applications, including engineering applications. Such engineering applications include, for example, automotive parts, tools, and aircraft parts. Most of the polymer articles used in engineering applications have polar groups. Examples of such engineering polymers include nylons, polyaryletherketones, polyetherimides, and polycarbonates. Due to the presence of the polar groups, polar solvents, such as water, affect the polymer articles. For example, the polymer articles form hydrogen bonds with water, due to which absorption of water takes place. Absorption of water causes numerous effects including: (1) temporary loss of physical properties, such as tensile strength and chemical resistance; (2) dimensional change or swelling of chains; (3) fading and discoloration; and (4) cracking of the polymer article.

Such polymer articles are typically cleaned in a barrel tumbler with steel media and a detergent in water. However, such cleaning methods are unable to restore the color of the faded polymer articles and, in fact, exacerbate the above-mentioned problems, e.g., leading to further fading, discoloration, and degradation of physical properties. As a result, remanufacture and recycling of the polymer articles is limited due to improperly cleaned parts.

SUMMARY OF THE INVENTION

The present invention relates to a method of restoring a contaminated polymer article. This method involves contacting a contaminated polymer article with an oil which is not a plasticizer under conditions effective to remove substantially all contaminants present on the polymer article to produce a restored polymer article.

The present invention also relates to a method of restoring a contaminated polymer article including contacting a contaminated polymer article with an oil which is not a plasticizer under conditions effective to remove substantially all contaminants present on the polymer article to produce a restored polymer article, wherein the oil which is not a plasticizer is heated to from about 10° C. to about 5° C. below the maximum service temperature of the polymer article.

Another aspect of the present invention is a method of restoring a contaminated polymer article including contacting a contaminated polymer article with a soybean oil which is not a plasticizer under conditions effective to remove substantially all contaminants present on the polymer article to produce a restored polymer article.

The use of an oil to restore a contaminated polymer article in the method of the present invention allows the elimination of contaminants on the article, in particular, polar polymer articles, without fading, discoloration, or adversely affecting the physical properties of the polymer article. More specifically, by using an oil which is not a plasticizer in the method of the present invention, any grime or grease on the polymer article will be dissolved by the oil, without dissolving the polymer article itself. In addition, the oil may be rinsed from the polymer article surface, leaving a clean, non-tacky surface.

DETAILED DESCRIPTION OF THE INVENTION

The present invention relates to a method of restoring a contaminated polymer article. This method involves contacting a contaminated polymer article with an oil which is not a plasticizer under conditions effective to remove substantially all contaminants present on the polymer article to produce a restored polymer article.

In accordance with the present invention, the polymer article may be polar or non-polar. In one embodiment of the invention, the polymer article is polar. Suitable polymer articles in accordance with the present invention include a polyamide article, a polyimide article, an acetal article, a polycarbonate article, an acrylic article, a fluoropolymer article, a polystyrene article, an acrylonitrilebutadienestyrene article, a polysulfone article, a polyaryletherketone article, and a thermoset polymer article.

There are different types of polyamides or nylons which are suitable polymer articles in accordance with the present invention, such as PA-66, PA-9, PA-11, and PA-12. The maximum service temperature for such nylons is about 75° C. They have excellent flexibility and impact resistance, but water absorption is a problem. They can be used for making gears, clothes, fuel nozzles, and automotive parts. Some of the nylons can work at high temperature.

Suitable polyimide articles include polyetherimide and polyimide.

Suitable acetal articles include polyoxomethyl and polyphenyloxide. Acetal articles exhibit excellent strength, stiffness, surface hardness, barrier properties, and solvent resistance due to high levels of crystallinity. The maximum service temperature for such acetal articles is about 100° C.

Suitable polycarbonate articles include polycarbonates and polycarbonate acrylonitrilebutadienestyrene alloys. Polycarbonates are known for their excellent clarity. They have excellent mechanical properties, but absorb water at high temperatures. They are sensitive to aromatic, chlorinated solvents and have poor resistance to alkali solutions.

Suitable acrylic articles include polymethylmethacrylate (PMMA). PMMA has good coloring properties and its UV stability is good. In repeated hot water washes PMMA tends to craze.

Suitable fluoropolymers include polytetrafluoroethylene (PTFE) and polyvinylidene fluoride (PVDF). Fluoropolymers have very good chemical properties and are used in many engineering applications, such as gears and high value electrical goods.

Suitable polystyrene articles include polystyrene, high impact polystyrene, acrylonitrilebutadienestyrene, acrylic-styrene acrylonitrile, styrene butadiene copolymers, and olefin-modified styrene acrylonitrile resins.

Suitable polysulfone articles include polyethersulfone and polysulfone. Suitable polyaryletherketone articles include polyetheretherketone and polyetherketone. These polymers are very stable and used in the aerospace industry. These materials have excellent impact and chemical resistance and they are used extensively as a resin in carbon fiber reinforced composites for challenging applications.

Suitable thermoset polymer articles include phenol formaldehyde, melamine, epoxy resins, and polyurea. The main difference between thermoplastic and thermnoset polymers is that a thermoset polymer cannot be melted again—i.e., it is a one time use.

Other suitable polymer articles include, but are not limited to, bismaleimides, cellulocs, fluoroplastics, ketone based polymers, melamine formaldehyde, phenolics, polyamide-imides, polyarylate, polybenzimidazole, polybutylene, polyester thermoplastics, such as liquid crystal polymers, polybutylene terephthalate, polycyclohexylenedimethylene terephthalate, and polyethylene terephthalate, polyester thermosets, polyethylene, polymethylpentene, polyphenylenes, such as polyphenylene oxide and polyphenylene sulfide, polyphthalamide, polypropylene, polyurethanes, silicon, thermoplastic elastomers, and vinyl based resins, such as polyvinylchloride, chlorinated polyvinylchloride, and vinylidene chloride.

As used herein, a contaminated polymer article is a polymer article as described above including one or more contaminants on at least a portion of its surface. Such contaminants include grease, petroleum, and dirt.

In accordance with the present invention, the contaminated polymer article is contacted with an oil which is not a plasticizer under conditions effective to remove substantially all contaminants present on the polymer article to produce a restored polymer article. As used herein, a plasticizer is a chemical solvent that is capable of dissolving the polymer article to some extent. Thus, as used herein, an oil which is not a plasticizer will not dissolve the polymer article, however the oil will dissolve contaminants present on the polymer article. The oil which is not a plasticizer is typically non-polar, however, the oil may also be polar. Suitable oils include a soybean oil, a coconut oil, a castor oil, a peanut oil, and a corn oil.

In one embodiment, the oil which is not a plasticizer is an emulsified oil. As used herein, an emulsified oil is an oil which has been emulsified with an emulsifying agent, which bonds with the oil which is not a plasticizer to make it slightly soluble in water. Suitable emulsifying agents include, but are not limited to, sodium dodecylsulfate and rosin soap. Thus, in accordance with the present invention, the oil which is not a plasticizer may be, for example, emulsified soybean oil or emulsified corn oil.

In the method of the present invention, the contaminated polymer article is contacted with the oil which is not a plasticizer using methods which are known to one of ordinary skill in the art. In one embodiment, contacting the contaminated polymer article with an oil which is not a plasticizer includes mixing the two components in an ultrasonic tank (e.g., a Crest Ultrasonics small capacity ultrasonic cleaner tank (Trenton, N.J.)), a barrel tumbler, or a vibrating degreaser. In another embodiment of the present invention, a pressure washer may also be used to contact the contaminated polymer article with the oil.

In accordance with the present invention, a mixing media may be added to the oil which is not a plasticizer, for example, when using a barrel tumbler or a vibrating degreaser. Suitable mixing media include, but are not limited to, a mixing blade, aluminum media, steel media, ceramic cubes, and plastic cubes. The mixing blade may be controlled by a variable speed drill, as is known in the art. The size and amount of the mixing media used is determined by numerous factors, including the equipment used to mix the polymer article with the oil and the size of the polymer article. Typically, the aluminum media, steel media, ceramic cubes, and plastic cubes are from about ½ cubic inches to about 2 cubic inches. Typically, up to about ¾ of the device (e.g., barrel or vibrating degreaser) is filled with mixing media. In this embodiment, the oil which is not a plasticizer is typically present in an amount sufficient to cover the contaminated polymer article(s) in the mixture.

The duration of contacting is determined by the amount of contaminants on the polymer article to be restored. However, contacting times of from about 10 minutes to about 20 minutes are desirable.

The temperature of the mixture of the polymer article and oil is determined by the maximum service temperature (or thermal stability temperature or maximum use temperature) of the polymer article being restored. As used herein, the maximum service temperature is the temperature at which properties will change sufficiently such that the polymer article is not able to function properly in its normal use. In accordance with the present invention, the temperature of the oil in the mixture ranges from room temperature to near, but below the maximum service temperature of the polymer article being restored. In one embodiment, the oil is heated to from about 10° C. to about 5° C. below the maximum service temperature of the polymer article. In another embodiment, the temperature of the oil in the mixture is from about 65° C. to about 90° C.

The use of heated oil in the method of the present invention facilitates restoring the polymer article to its original color. Although not wishing to be bound by theory, it is believed that the heated oil extracts water present within the polymer by breaking the hydrogen bonds between the water and the polymer article, thus reducing the fading present on the polymer article. In addition, a thin layer of oil remains on the restored polymer article of the present invention, thus restoring shine to the polymer article.

In one embodiment of the present invention, the oil which is not a plasticizer and polymer article are mixed in an ultrasonic tank and the oil is degassed prior to mixing with the contaminated polymer article. Degassing may be achieved by methods known to those of ordinary skill in the art, including running the ultrasonic tank with just the oil present prior to addition of the contaminated polymer. Degassing the oil removes air molecules which can absorb the ultrasonic energy.

In accordance with the present invention, the restored polymer article includes less than about 10% contaminants, desirably, less than about 5% contaminants.

In another embodiment of the present invention, the restored polymer article is rinsed with a rinsing agent under conditions effective to remove substantially all oil from the restored polymer article. In accordance with this embodiment of the present invention, less than about 1% of the oil which is not a plasticizer remains on the polymer article.

Suitable rinsing agents include water and organic solvents. Suitable organic solvents include, but are not limited to, non-polar solvents, such as trichloroethylene and acetone.

Techniques for rinsing the restored polymer article include, but are not limited to, mixing the restored polymer article with the rinsing agent in an ultrasonic tank, a barrel tumbler, or a vibrating degreaser, or rinsing with a pressure washer. In one embodiment, the rinsing agent includes a mixing media. Typically, the restored polymer article is rinsed with the rinsing agent for from about 10 minutes to about 20 minutes, however, the duration of rinsing is determined by the rinsing agent used.

In yet another embodiment of the present invention, the oil is filtered under conditions effective to substantially remove contaminants in the oil. In particular, a filter may be provided in the ultrasonic tank or barrel tumbler to remove contaminants in the oil. Suitable filters include barrel type filters, membrane type filters, and skimmers. In accordance with this embodiment of the present invention, the oil may be recycled and reused in the above-described process of the present invention.

The present invention also relates to a method of restoring a contaminated polymer article including contacting a contaminated polymer article with an oil which is not a plasticizer under conditions effective to remove substantially all contaminants present on the polymer article to produce a restored polymer article, wherein the oil which is not a plasticizer is heated to from about 10° C. to about 5° C. below the maximum service temperature of the polymer article.

Another aspect of the present invention is a method of restoring a contaminated polymer article including contacting a contaminated polymer article with a soybean oil which is not a plasticizer under conditions effective to remove substantially all contaminants present on the polymer article to produce a restored polymer article.

The use of an oil to restore a contaminated polymer article in the methods of the present invention allows the elimination of contaminants on the article without causing fading, discoloration, or degradation of physical properties. In particular, when using an oil to restore the polymer article (as compared to water in prior art techniques), no water absorption takes place and, as a result, there is no temporary loss of physical properties, fading, or discoloration. Since the oil in accordance with the present invention is not a plasticizer, the oil will dissolve the contaminants on the polymer article's surface without dissolving the polymer article itself. Further, the environmental impact of the oils used in the method of the present invention is significantly less than other non-polar solvents. Moreover, the use of heated oil in the method of the present invention facilitates restoring the polymer article to its original color. A polymer article which is properly restored in accordance with the present invention is easier to remanufacture and recycle, as contaminants which limit reuse of parts are eliminated and its useful life can be more easily determined.

EXAMPLES

Example 1

Restoration of Pump Handles at 60° C.

Approximately 11 quarts of edible soybean oil was used to fill a Crest Ultrasonics small capacity ultrasonic cleaner tank (Trenton, N.J.) (all examples used the Crest Ultrasonics small capacity ultrasonic cleaner tank) to a level suitable to cover the polymer articles to be added. The oil was maintained at temperature of 60° C. The oil was degassed by running the ultrasonic machine or approximately 15 minutes, without the polymer articles.

After degassing and heat stabilization of the oil, the basket for the Crest unit was loaded with six large, black, polyamide gas pump handles (Nylon 66, Davis Airtech, Atlanta, Ga.). The pump handles were submerged for 15 minutes in the oil, removed, rinsed with cold water, and hand wiped with paper towel material to remove any excess oil.

Outside surfaces appeared clean with a tacky oily feel on them, but inner surfaces still contained contaminate material. This material was loose and it seemed that additional agitation would be required.

Example 2

Restoration of Pump Handles and Levers at 70° C.

After degassing and heating of the oil to 70° C., as described in Example 1, four polyamide pump handles and three polyamide pump levers (all Nylon 66, Davis Airtech, Atlanta, Ga.) were immersed in the ultrasonic container for fifteen minutes with full ultrasonic power applied. Then the parts were cold water rinsed under tap water and hand wiped with paper towel material. Results were similar to the results in Example 1. It appeared that additional agitation would facilitate more complete removal of contaminants.

Example 3

Restoration of Pump Handles Using Emulsified Oil

Soybean oil was emulsified with SOYsolv II™ (SOYsolv, Tiffin, Ohio) so that rinsing of parts could be achieved effectively. Different ratios of Soysolv II and soybean oil were used. In particular, from about 0.5:10 to about 1:2 Soysolv II to soybean oil was used. After degassing and heating the oil to 70° C., five polyamide pump handles (Nylon 66, Davis Airtech, Atlanta, Ga.) were immersed for ten minutes in the emulsified soybean oil. A mixing blade was introduced, controlled by a variable speed ⅜ drill (Dewalt DW 100, Baltimore, Md.), run at medium speed, to provide additional agitation for two minutes. The parts were then rinsed and hand-wiped with soft paper towel material to remove any excess oil. Results were greatly improved over those from Examples 1 and 2. The parts were more completely clean with very little if any soil remaining.

Example 4

High Temperature Test

The pump parts of Example 2 and 3 where subsequently placed in a lab oven at 55° C. for 36 hours in order to test the effect of the above-described process on the polymer articles. In particular, the high temperature test was designed to show any evidence of fatigue, fading, and discoloration within a shortened time period. Upon removal from the oven, the pump parts appeared normal. There was no discoloration, however, the parts did display an oily film or greasy feel. This was attributed to their being subjected to higher than normal temperature for a sustained period. Normally, the highest temperature the parts would be expected to encounter would be under 40° C. for less than eight hours.

The pump parts were also placed in a microwave oven for three minutes at high power. No noticeable change is aesthetics was observed.

Example 5

Use of Emulsified Soybean Oil

Examples 1 and 2 were repeated using the emulsified oil of Example 3. The pump parts were clean and had no tacky feel. This indicated that the use of emulsified oil improved the rinsing of the pump parts.

Although preferred embodiments have been depicted and described in detail herein, it will be apparent to those skilled in the relevant art that various modifications, additions, substitutions, and the like can be made without departing from the spirit of the invention and these are therefore considered to be within the scope of the invention as defined in the claims which follow.

What is claimed:

1. A method of restoring a contaminated polymer article comprising contacting a contaminated polymer article with an oil which is not a plasticizer under conditions effective to remove substantially all contaminants present on the polymer article to produce a restored polymer article, wherein the oil which is not a plasticizer is heated to from about 10° C. to about 5° C. below the maximum service temperature of the polymer article.

2. The method according to claim 1 further comprising adding a mixing device to the oil.

3. The method according to claim 1 wherein the polymer article is a polyamide article, a polyimide article, an acetal article, a polycarbonate article, an acrylic article, a fluoropolymer article, a polystyrene article, an acrylonitrilebutadienestyrene article, a polysulfone article, a polyaryletherketone article, or a thermoset polymer article.

4. The method according to claim 1 wherein the oil is a soybean oil, a coconut oil, a castor oil, a peanut oil, or a corn oil.

5. The method according to claim 1 wherein the oil is an emulsified oil.

6. The method according to claim 1 wherein the contacting comprises mixing the contaminated polymer article and the oil in an ultrasonic tank.

7. The method according to claim 1 further comprising rinsing the restored polymer article with a rinsing agent under conditions effective to remove substantially all oil from the restored polymer article.

8. The method according to claim 1 further comprising filtering the oil under conditions effective to substantially remove contaminants in the oil.

9. The method according to claim 2 wherein the mixing device is selected from the group consisting of a mixing blade, aluminum media, steel media, ceramic cubes, and plastic cubes.

10. The method according to claim 7 wherein the rinsing agent is selected from the group consisting of water and organic solvents.

11. The method according to claim 7 wherein the rinsing comprises mixing the restored polymer article with the rinsing agent in an ultrasonic tank such that the rinsing agent contacts the restored polymer article in the ultrasonic tank.

12. The method according to claim 7 further comprising adding a mixing device to the rinsing agent.

13. The method according to claim 12 wherein the mixing device is selected from the group consisting of a mixing blade, aluminum media, steel media, ceramic cubes, and plastic cubes.

14. A method of restoring a contaminated polymer article comprising contacting a contaminated polymer article with a soybean oil which is not a plasticizer under conditions effective to remove substantially all contaminants present on the polymer article to produce a restored polymer article, wherein the soybean oil is heated to from about 10° C. to about 5° C. below the maximum service temperature of the polymer article.

15. The method according to claim 14 wherein the polymer article is a polyamide article, a polyimide article, an acetal article, a polycarbonate article, an acrylic article, a fluoropolymer article, a polystyrene article, an acrylonitrilebutadienestyrene article, a polysulfone article, a polyaryletherketone article, or a thermoset polymer article.

16. The method according to claim 14 wherein the soybean oil is an emulsified soybean oil.

17. The method according to claim 14 wherein the contacting comprises mixing the contaminated polymer article and the soybean oil in an ultrasonic tank.

18. The method according to claim 14 further comprising rinsing the restored polymer article with a rinsing agent under conditions effective to remove substantially all oil from the restored polymer article.

19. The method according to claim 14 further comprising filtering the oil under conditions effective to substantially remove contaminants in the oil.

* * * * *